United States Patent [19]

Aasari et al.

[11] 4,430,877

[45] Feb. 14, 1984

[54] METHOD AND CLEANING CONTAINER ON INDIRECT EXTRUSION PRESS

[75] Inventors: Akira Aasari, Osaka; Tatsuhiko Noyori, Kobe; Yukuo Mizoguchi, Shimonoseki; Tetsuro Takehata, Osaka, all of Japan

[73] Assignee: Kabushiki Kaisha Kobe Seiko Sho, Kobe, Japan

[21] Appl. No.: 265,613

[22] Filed: May 20, 1981

[30] Foreign Application Priority Data

Dec. 27, 1980 [JP] Japan ..... 55-188152

[51] Int. Cl.[3] ..... B21C 25/02; B21C 35/06

[52] U.S. Cl. ..... 72/273.5; 72/255

[58] Field of Search ..... 72/255, 263, 273.5, 72/253.1

[56] References Cited

U.S. PATENT DOCUMENTS

| | | | |
|---|---|---|---|
| 4,154,081 | 5/1979 | Boshold | 72/273.5 |
| 4,231,245 | 11/1980 | Ishiba | 72/273.5 |

FOREIGN PATENT DOCUMENTS

| | | | |
|---|---|---|---|
| 2237276 | 2/1973 | Fed. Rep. of Germany | 72/255 |
| 17816 | 5/1977 | Japan | 72/273.5 |
| 69135 | 10/1977 | Japan | 72/273.5 |

*Primary Examiner*—Lowell A. Larson

*Attorney, Agent, or Firm*—Oblon, Fisher, Spivak, McClelland & Maier

[57] ABSTRACT

A method for cleaning inner surfaces of a container on an indirect extrusion press, using a loose die including an extruding die portion and a separable cleaning die portion. The die is continuously used after contributing to the cleaning in each cycle of press operation, replacing the cleaning die portion alone in an ejected position after extrusion of a billet.

2 Claims, 19 Drawing Figures

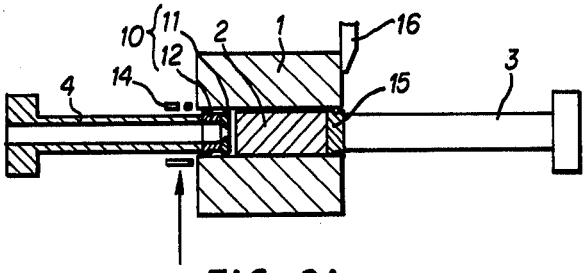
FIG. 2A
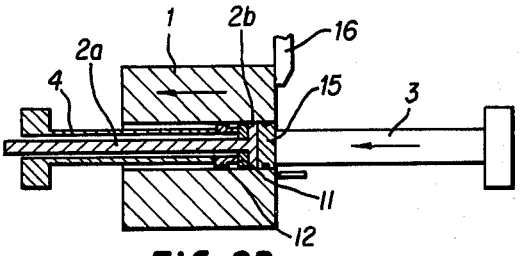
FIG. 2B
FIG. 2C
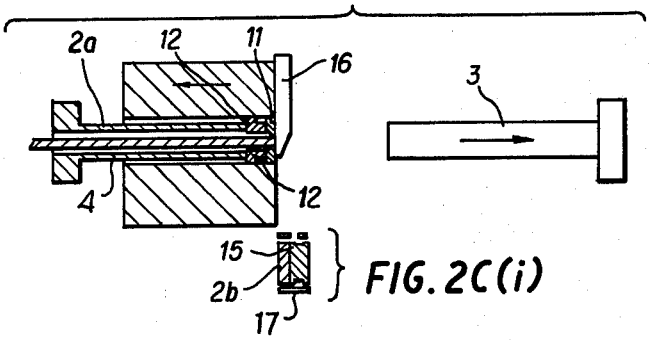
FIG. 2C(i)
FIG. 2D
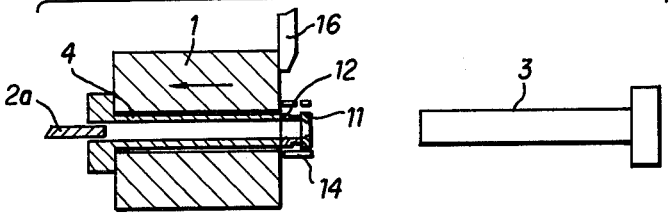
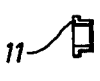
FIG. 2D(i)

FIG. 2E
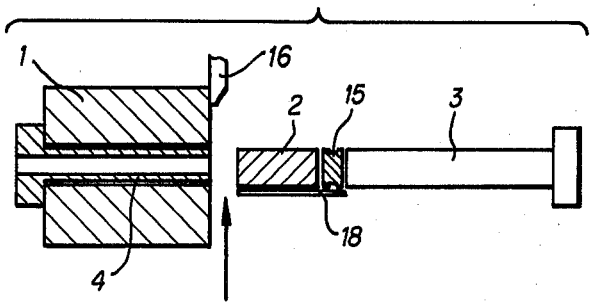
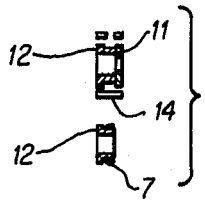
FIG. 2E(I)
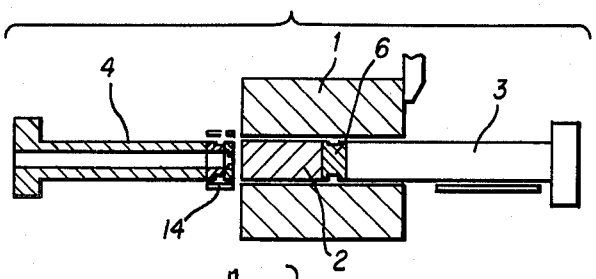
FIG. 2F
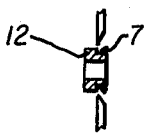
FIG. 2F(i)
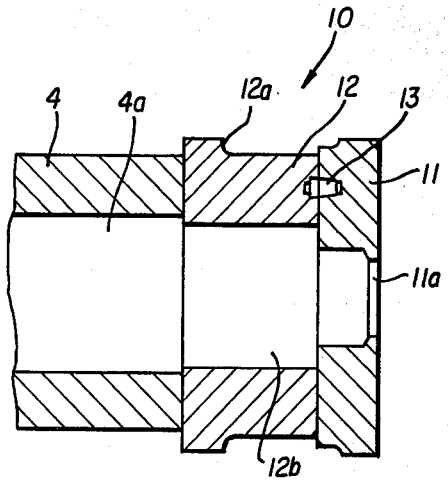
FIG. 3

METHOD AND CLEANING CONTAINER ON INDIRECT EXTRUSION PRESS

BACKGROUND OF THE INVENTION

1. Field of the Invention

This invention relates generally to methods for cleaning inner surfaces of containers of indirect extrusion presses, and more particularly to a method for cleaning inner surfaces of a container by utilizing an extruding die itself, permitting continued use of the die after contributing to the cleaning in each cycle of press operation to ensure uniform accuracy of extruded products. It is also contemplated to shorten the time period of the cycle of the press operation. The method provides especially good results in the production on a small scale of diversified kinds of extruded articles.

2. Description of the Prior Art

In the production of various extruded articles of high tensile aluminum alloys for indirect extrusion presses, it is generally required to remove shells deposited on the inner surfaces of a container prior to the extruding phase in each cycle of operation in order to have good surface quality of the product. In this regard, there have been employed various cleaning mechanisms, including cleaning edges or edged surfaces formed on a die to clean the container by the die itself, use of a dummy block or resort to mechanism which is exclusively provided for cleaning. From the viewpoint of shortening the press cycle time, the method of utilizing a die itself is advantageous as cleaning is effected simultaneously with extrusion. However, the provision of an edged surface or edges integrally on the extruding die in turn gives rise to the necessity of removing the shells which have been transferred onto the die, in addition to the problem of abrasive wear of edged surfaces or cleaning edges. Since it is difficult to remove the shells from the die during the dry cycle time of the press, the conventional procedure has been to provide a plurality of dies, using one die in each cycle of extruding operation while removing shells from other dies at a point outside the press machine. Therefore, it has been necessary to provide more than two dies of exactly the same design, which is obviously disadvantageous in view of the die cost as well as the severe tolerance of errors as imposed in the die manufacture, and from which no further reductions of the time period of the cycle of the press operation can be expected. The preparation of dies of uniform dimensions is extremely difficult, especially in the situation of extrusion of products having a thin profile. Therefore, application of the above-mentioned method is limited to extruding operations of the sort which involves drawing in a subsequent stage. The cleaning of the container by the extruding dies requires higher die costs on a small-scale of diversified kinds of extrusion articles.

SUMMARY OF THE INVENTION

The present invention has as its primary object the elimination of the above-mentioned problems connected with the cleaning of inner surfaces of a container of an indirect extrusion press by an extruding die itself.

It is a more specific object of the present invention to provide a method for cleaning a container on an indirect extrusion press, including: providing a loose die having of an extruding die portion and a separable cleaning die portion; setting the loose die on a die stem; automatically cleaning inner surfaces of a container simultaneously with extrusion of a billet by movement of the die relative to a pressurizing stem or a closure block and the container; upon completion of extrusion replacing the separable cleaning die portion alone in an ejected position and resetting the loose die on the die stem.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein:

FIGS. A–D are schematic illustrations showing various conventional methods for cleaning inner surfaces of a container while FIGS. 1A(i)–1D(i) show in greater detail portions of FIGS. 1A–1D, respectively;

FIG. 2 is a similar schematic illustration but showing sequential phases of the press operation concurrent with the cleaning operation by the method according to the invention while FIGS. 2C(i)–2F(i) show members used in connection with FIGS. 2C–2F, respectively; and FIG. 3 is an enlarged sectional view of the loose die according to the invention.

DETAILED DESCRIPTION OF THE INVENTION AND PREFERRED EMBODIMENTS

Figure 1A:
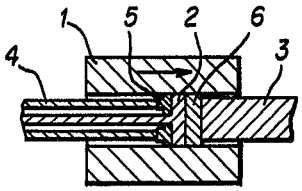
Figure 1A:
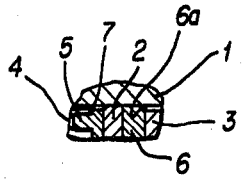
Figure 1B:
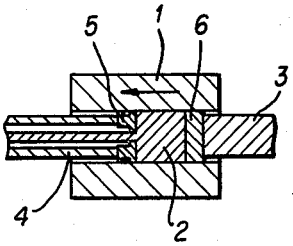
Figure 1B:
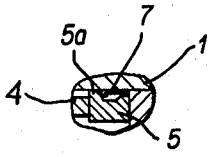
Figure 1C:
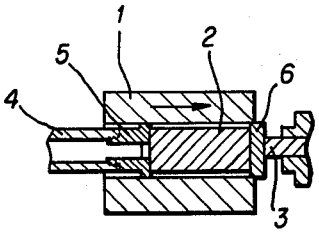
Figure 1C:
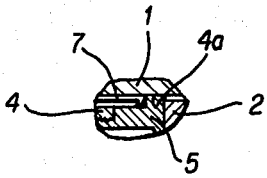
Figure 1D:
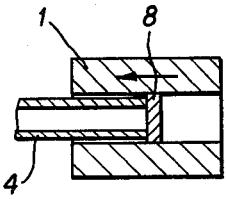
Figure 1D:
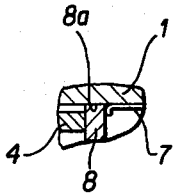

The invention is hereafter described more particularly by way of preferred embodiments shown in the drawings. Before going into particulars of the invention, reference is first had to FIGS. 1A–D which illustrate various conventional methods for cleaning inner surfaces of a container by a die and in which indicated by reference number 1 is a container, by 2 a billet to be extruded, by 3 a pressurizing stem, by 4 a die stem, and by 5 a conventional extruding die. Shown in FIGS. 1A and 1A(i) is a cleaning method by a dummy block which is positioned at the fore end of pressurizing stem 3 for pushing billet 2 and has a cleaning structure *6a* (edged surface or blades suitable for the removal of shells) formed integrally around the outer periphery thereof, scraping shells off the inner surfaces of the container 1 which is moved in the arrowed direction after extrusion. Illustrated in FIGS. 1D and 1D(i) is a method of using a clean-out disc 8 as a cleaning member, which is set on die stem 4 and provided with a cleaning structure *8a* along its front edges for removing shells 7 from the inner surfaces of container 1 during relative movement of container 1 in the arrowed direction. The methods shown in FIGS. 1A–D invariably invite an increase in the time period of the press cycle, involving an inefficiently troublesome operation. The methods shown at FIGS. 1B and 1C perform cleaning by die 5 itself which, in the case of FIG. 1B, is provided with flanges along its front and rear edges and has a cleaning structure *5a* formed integrally around the outer periphery of the rear flange, thereby automatically removing shells 7 from the inner surfaces of container 1 simultaneously with the extruding movement of pressurizing stem 3 in the arrowed direction. In the method of FIG. 1B, an extruding die 5 which has a flange along its inner edge is provided with a leading edge *5a* along and on the outer side of the inner flange, thereby removing shells 7 from the inner surfaces of container 1 during movement in the arrowed direction of the container 1. The method of FIGS. 1B and 1B(i) is efficient in that cleaning is automatically effected in the extruding phase of the operation. However, a cleaning structure like 5*a* which is formed integrally with extruding die 5 gives rise to the problems discussed hereinbefore.

In contrast to the conventional methods noted hereinabove, the present invention employs a loose separable extruding die 10 as shown in FIG. 3, which is capable of removing shells from the inner surfaces of a container 1 simultaneously with the extruding phase of the operation as in the method illustrated in FIGS. 2A–F. More particularly, the method of the invention employs separable loose die 10 as exemplified in FIG. 3 which, in the particular embodiment shown, includes an extruding die portion 11 central having aperture 11*a* for metal extrusion therethrough and a separable cleaning die portion 12 having a cleaning structure 12*a* of ring form around the outer periphery thereof and a bore 12*b* in communication with die opening 11*a* and an axial bore 4*a* forming a passage of extruded product through a die stem 4. Cleaning die portion 12 is detachably joined with die portion 11 by means of, for example, a plurality of positioning pins 13.

In order to clean inner surfaces of container 1, loose die 10 including extruding die portion 11 and separable cleaning die portion 12 is used in the following manner, according to the sequential phases of operation shown FIGS. 2A–F. FIG. 2A shows a phase where the die charge has been completed and loose die 10 set at the fore end of die stem 4 by a die loader 14 is charged into container 1 by the movement of the latter, while pressurizing stem 3 is pressed through a dummy block 15 against billet 2 loaded in container 1. After die loader 14 is retracted, pressurizing stem 3 and container 1 are moved forward as indicated by an arrow in FIG. 2B, which shows a phase where billet 2 is extruded through opening 11*a* in extruding die portion 11, delivering the extruded product out of the machine through axial passage 4*a* of die stem 4. Simultaneously with the extruding phase, shells 7 deposited on the inner surfaces of container 1 are scraped off by cleaning structure 12*a* of separable cleaning die portion 12, the scraped shells being deposited on the outer periphery of cleaning die portion 12. The extruding phase is followed by a shear phase shown in FIGS. 2C and 2C(i), wherein a discarded portion 2*b* of billet 2 is exposed by the movement of container 1 and, after retraction of pressurizing stem 3, severed off the rear end of the extruded product by lowering a shear member 16 whch is vertically movably mounted on container 1, holding severed discarded portion 2*b* and dummy block 15 by a discard loader 17 and retracting loader 17 to complete the severing operation.

In the next phase shown in FIGS. 2D and 2D(i) loose die 10 is exposed with respect to container 1 by the movement of the latter for die ejection by die loader 14 which holds die 10 and recedes into a retracted position outside the machine. In FIGS. 2E and 2E(i), the billet loader 18 commences charging a fresh billet 2 into container 1, while, on the part of retracted die loader 14, cleaning die portion 12 with the scraped shells 7 is detached from die portion 11 on die loader 14 and a fresh cleaning die portion 12 is attached thereto. Namely, extruding die portion 11 alone is repeatedly used although cleaning die portion 12 is replaced in each cycle of operation. Joined die 10 is set in position at the fore end of the die stem 4 by the die loader 14 as shown in FIGS. 2F and 2F(i) to proceed again in the die charging phase of FIG. 2A. In the meantime, detached cleaning die portion 12 is cleaned of the shells in preparation for the next service.

As clear from the foregoing description, for cleaning inner surfaces of conventional containers on indirect extrusion presses, the present invention employs a loose die 10 which is separable into an extruding die portion 11 with a shaping aperture 11*a* and a cleaning die portion 12 with a cleaning structure 12*a*, so that the cleaning operation for the removal of shells from the inner surfaces of a container by the die itself can be performed without prolonging the press cycle and within an even shorter time period as compared with the conventional methods. Since the forming die portion which defines the dimensions and shape of the product to be extruded is allowed to be used continuously without participating in the cleaning operation, it is possible to obtain extruded products of uniform dimensions and shape which are of utmost importance in some cases and to ensure stable and uniform quality in the extrusion of shape materials with a severe tolerance of errors. In addition, laborious or costwise disadvantages as encountered in the methods which require a large number of extruding dies for alternate use are completely eliminated. In the event the dies have to be discarded due to abrasive wear after use over a certain period of time, fabrication of the cleaning die portions alone is easier and less expensive than the fabrication of whole extruding dies. The cleaning of containers by the use of separable loose dies is particularly advantageous in a situation where a large number of different dies are required, for instance, where a diversity of articles are extruded on a small scale.

Although the cleaning method of the invention has been exemplified in connection with a container of a double stem type indirect extrusion press in the foregoing embodiment, the invention includes a closure block in the case of the single stem indirect extrusion press as represented by the pull-back type.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for cleaning a container on an indirect extrusion press which includes, a die stem, a pressurizing stem and a loose die having an extruding die portion and a separable cleaning die portion, which comprises at least one cycle of the following steps:

setting said loose die on said die stem;

automatically cleaning the inner surfaces of said container while simultaneously extruding a billet by movement of said loose die relative to said pressurizing stem and said container;

shearing an unextruded portion of said billet from said loose die;

ejecting said loose die from said container;

replacing said separable cleaning die portion with a further cleaning die portion in an ejected position while retaining said extruding die portion; and resetting said loose die on said die stem wherein said cleaning die portion is replaced following each cleaning and extruding step of each of said cycle.

2. A method as set forth in claim 1, including the step of cleaning said cleaning die portion after said ejecting step, wherein said separable cleaning die portion and said extruding die portion together define an annular cleaning structure.

* * * * *

UNITED STATES PATENT AND TRADEMARK OFFICE

CERTIFICATE OF CORRECTION

PATENT NO. : 4,430,877

DATED : February 14, 1984

INVENTOR(S) : Akira Asari et al.

It is certified that error appears in the above-identified patent and that said Letters Patent are hereby corrected as shown below:

On cover sheet, line 2, delete "Aasari et al." and insert therefor --Asari et al.--;

On cover sheet, [75] Inventors, delete "Akira Aasari" and insert therefor --Akira Asari--;

In column 1, line 20, delete "for" and insert therefor --by--;

In column 1, line 28, between "to" and "mechanism" insert --a--;

In column 1, line 66, before "an" delete "of";

In column 1, line 57, insert --column 2 lines 34-68 and column 3 lines 1-6--;

In column 2, line 34, after "FIGS. 1A-D" delete "which";

UNITED STATES PATENT AND TRADEMARK OFFICE

CERTIFICATE OF CORRECTION

PATENT NO. : 4,430,877

DATED : February 14, 1984

INVENTOR(S) : Akira Asari et al.

It is certified that error appears in the above-identified patent and that said Letters Patent are hereby corrected as shown below:

In column 2, line 45, between "scraping" and "shells" insert --the--;

In column 2, line 45, after "surfaces of" delete "the";

In column 3, line 16, between "11" and "central" insert --a--;

In column 3, line 44, delete "wherein" and insert therefor --where a--.

Signed and Sealed this

*Thirty-first* Day of *July 1984*

[SEAL]

*Attest:*

GERALD J. MOSSINGHOFF

*Attesting Officer*

*Commissioner of Patents and Trademarks*